US007271528B2

(12) United States Patent
Knappenberger

(10) Patent No.: US 7,271,528 B2
(45) Date of Patent: Sep. 18, 2007

(54) UNIFORM EMITTER ARRAY FOR DISPLAY DEVICES

(75) Inventor: Eric J. Knappenberger, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 104 days.

(21) Appl. No.: 10/715,058

(22) Filed: Nov. 17, 2003

(65) Prior Publication Data

US 2004/0094505 A1 May 20, 2004

Related U.S. Application Data

(62) Division of application No. 10/011,135, filed on Dec. 7, 2001, now Pat. No. 6,890,446, which is a division of application No. 09/368,013, filed on Aug. 3, 1999, now Pat. No. 6,426,233.

(51) Int. Cl.
*H01J 1/00* (2006.01)

(52) U.S. Cl. ..... 313/310; 216/11; 216/24; 216/41; 216/51

(58) Field of Classification Search ..... None
See application file for complete search history.

(56) References Cited

U.S. PATENT DOCUMENTS

| | | | | |
|---|---|---|---|---|
| 4,650,744 | A | 3/1987 | Amano | |
| 5,228,877 | A | 7/1993 | Allaway et al. | |
| 5,302,238 | A | 4/1994 | Roe et al. | |
| 5,312,514 | A | 5/1994 | Kumar | |
| 5,345,365 | A | 9/1994 | Herndon et al. | |
| 5,372,973 | A | 12/1994 | Doan et al. | |
| 5,391,259 | A * | 2/1995 | Cathey et al. | 438/20 |
| 5,532,177 | A | 7/1996 | Cathey | |
| 5,591,352 | A | 1/1997 | Peng | |
| 5,656,525 | A | 8/1997 | Lin et al. | |
| 5,659,562 | A | 8/1997 | Hisa | |
| 5,676,853 | A | 10/1997 | Alwan | |
| 5,811,020 | A | 9/1998 | Alwan | |
| 5,830,373 | A | 11/1998 | Ohtake et al. | |
| 5,836,797 | A | 11/1998 | Suzuki et al. | |
| 5,863,232 | A | 1/1999 | Lee | |
| 5,895,580 | A | 4/1999 | Liu et al. | |
| 5,899,706 | A | 5/1999 | Kluwe et al. | |
| 6,017,772 | A | 1/2000 | Derraa | |
| 6,027,388 | A | 2/2000 | Jones et al. | |

(Continued)

FOREIGN PATENT DOCUMENTS

| | | |
|---|---|---|
| JP | 60-226129 | 11/1985 |

*Primary Examiner*—Anita Alanko
(74) *Attorney, Agent, or Firm*—TraskBritt

(57) ABSTRACT

An emitter array produced using etch mask and a method for making such an etch mask. The emitter comprises a substrate, forming a conducting layer on the substrate, forming an emitting layer on the conducting layer, forming an etch mask having a controlled distribution of a plurality of mask sizes over the emitting layer, and forming at least one emitter by removing portions of the emitting layer using the etch mask. The method for making the etch mask comprises forming an etch mask layer over an emitting layer, forming a patterning layer having a controlled distribution of mask sizes over the etch mask layer, and forming the etch mask by removing portions of the etch mask layer using the controlled distribution of mask sizes in the patterning layer.

20 Claims, 5 Drawing Sheets

U.S. PATENT DOCUMENTS 6,030,452 A 2/2000 Takeuchi
6,037,104 A 3/2000 Lahaug
6,051,149 A 4/2000 Frendt
6,080,325 A 6/2000 Cathey et al.
6,174,449 B1 1/2001 Alwan et al.
6,184,699 B1 2/2001 Smith et al.
6,190,992 B1 2/2001 Sandhu et al.
6,211,096 B1 4/2001 Allman et al.
6,228,538 B1 5/2001 Michiels et al.
6,426,233 B1 7/2002 Knappenberger
6,464,890 B2 10/2002 Knappenberger et al.

* cited by examiner

UNIFORM EMITTER ARRAY FOR DISPLAY DEVICES

CROSS-REFERENCE TO RELATED APPLICATIONS

This application is a divisional of application Ser. No. 10/011,135, filed Dec. 7, 2001, now U.S. Pat. 6,890,446, issued May 10, 2005, which is a divisional of application Ser. No. 09/368,013, filed Aug. 3, 1999, now U.S. Pat. No. 6,426,233, issued Jul. 30, 2002.

GOVERNMENT LICENSE RIGHTS

This invention was made with Government support under Contract No. DABT63-97-C-0001 awarded by Advanced Research Projects Agency (ARPA). The Government has certain rights in this invention.

BACKGROUND OF THE INVENTION

This invention relates to display devices, such as field emission displays, plasma displays, and flat panel cathode ray tubes. Specifically, the invention relates to a uniform emitter array for display devices, an etch mask used in making the same, and methods for making the emitter array and etch mask.

Display devices visually present information generated by computers and other electronic devices. One category of display devices is electron emitter apparatus, such as a cold cathode field emission display (FED). An FED uses electrons originating from one or more emitters on a baseplate (also known as the panel) to illuminate a luminescent display screen and generate an image. The emitters can be arranged in groups called pixels. A gate electrode, located near the emitter, and the baseplate are in electrical communication with a voltage source. Electrons are emitted when a sufficient voltage differential is established between the emitter and the gate electrode. The electrons strike a phosphor coating on the display screen, releasing photons to generate a visual image.

As shown in drawing FIGS. 1 and 2, emitters have been formed by etching portions of silicon layer 100 using oxide etch mask 102. The etching process is anisotropic, removing portions of silicon layer 100 underlying oxide etch mask 102 as well as portions not underlying the etch mask, thereby forming emitter tips 104. See, for example, U.S. Pat. Nos. 5,676,853, 5,302,238, 5,312,514, 5,372,973, 5,532,177, and 5,391,259. In such processes, a higher degree of etching removes more of silicon layer 100, forming a shorter emitter tip. Conversely, a lower degree of etching removes less of silicon layer 100, forming a longer emitter tip.

High resolution displays yield brighter images on the display screen and are therefore in high demand. High resolution displays may be obtained by creating a focused electron beam which reduces off-angle beams and mislanded electrons and therefore yields a brighter image. One method of obtaining such a focused electron beam is to fabricate emitters with substantially similar heights. The voltage is then applied to a gate electrode and such emitters extract a high number of electrons since the distance between the gate electrode and the emitter is uniform. If the height of the emitters is not uniform throughout the panel, the distance between the gate electrode and the emitters can vary from one emitter to the next. When this occurs, the number of electrons and the direction of emission vary, yielding a dimmer image because fewer electrons strike the display screen in the same area.

A problem with conventional emitters arrayed on a panel has been the non-uniformity of the emitter height. Emitters are often longer in the interior of the panel and shorter in the periphery of the panel because of etching reactor design and etching reactor loading of panels. The design of etching reactors causes slower etching in the interior of the panel and quicker etching in the periphery of the panel. Etching reactor loading—where etching is slower in the interior of the reactor because the etching process occurs in all directions and faster in the periphery of the reactor, especially the edges, because the etching does not occur in all directions—also contributes to this non-uniformity. This non-uniformity of the emitter height, as discussed above, has contributed to dimmer images.

BRIEF SUMMARY OF THE INVENTION

The present invention includes a method for making an emitter for a display device by providing a substrate, forming a conducting layer on the substrate, forming an emitting layer on the conducting layer, forming an etch mask with a controlled distribution of a plurality of mask sizes over the emitting layer, and forming at least one emitter by removing portions of the emitting layer using the etch mask. The controlled distribution of mask sizes may contain one mask size as a median mask size and an equal number of larger and smaller mask sizes, where every larger mask size has a corresponding smaller mask size with the average of the corresponding smaller and larger mask sizes being the median mask size. The resulting field emission display device contains a plurality of pixels, where each pixel has at least one emitter with a substantially similar height.

The present invention also includes a method for making an etch mask for a display device emitter and the etch mask produced by this method. The method is practiced by forming an etch mask layer over an emitting layer, forming a patterning layer having a controlled distribution of mask sizes over the etch mask layer, and forming the etch mask by removing portions of the etch mask layer using the controlled distribution of mask sizes in the patterning layer. The controlled distribution of mask sizes may contain one mask size as a median mask size and an equal number of larger and smaller mask sizes, where every larger mask size has a corresponding smaller mask size with the average of the corresponding smaller and larger mask sizes being the median mask size. The larger mask sizes are located primarily in the periphery of the etch mask, the smaller mask sizes are located primarily in the interior, and the median mask size is located throughout the etch mask.

The present invention also includes an emitter array for a field emission display device containing a plurality of pixels where at least one emitter in every pixel is substantially the same height. The at least one emitter may have a size of about 1.6 microns. Preferably, all emitter heights may be within 0.15 microns of each other, or, in other words, the height of any one emitter differs no more than about ten percent (10%) from another.

The present invention compensates for the non-uniformity introduced into emitter heights during formation by etching, which causes over- and under-sharpening of tips and alters their emission properties. By providing more uniform emitter heights throughout the field emission display device, the present invention leads to better emission properties and a brighter image.

BRIEF DESCRIPTION OF THE SEVERAL VIEWS OF THE DRAWINGS

Part of the present invention is illustrated by the accompanying drawings in which.

DETAILED DESCRIPTION OF THE INVENTION

The present invention provides a method for enhancing the uniformity of emitters in display devices. The enhanced emitter uniformity is obtained by using an etch mask with a controlled distribution of mask sizes. The etch mask contains larger mask sizes primarily in the periphery and smaller mask sizes primarily in the interior to compensate for the non-uniform etching during formation of the emitters.

The following description provides specific details, such as material thicknesses and types, in order to provide a thorough understanding of the present invention. The skilled artisan, however, will understand that the present invention may be practiced without employing these specific details. Indeed, the present invention can be practiced with conventional fabrication techniques employed in the industry.

The process steps and structures described below do not form a complete process flow for manufacturing integrated circuit semiconductor devices (IC devices), the remainder of which is known to those of ordinary skill in the art. Accordingly, only the process steps and structures necessary to understand the present invention are described.

Figure 1:
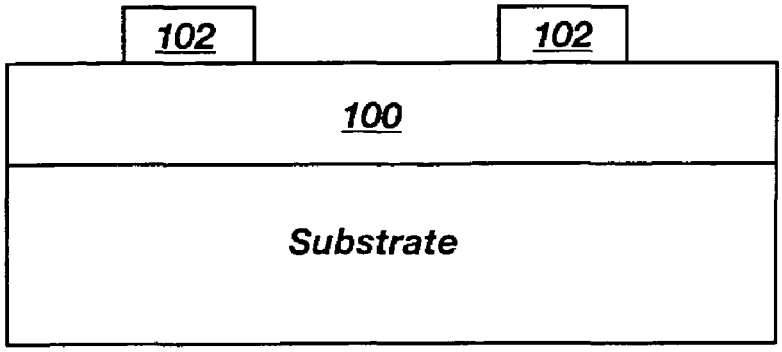
Fig. 1 (PRIOR ART)
FIGS. 1 and 2 illustrate cross-sectional views of a process of forming emitters according to a conventional method.
Figure 2:
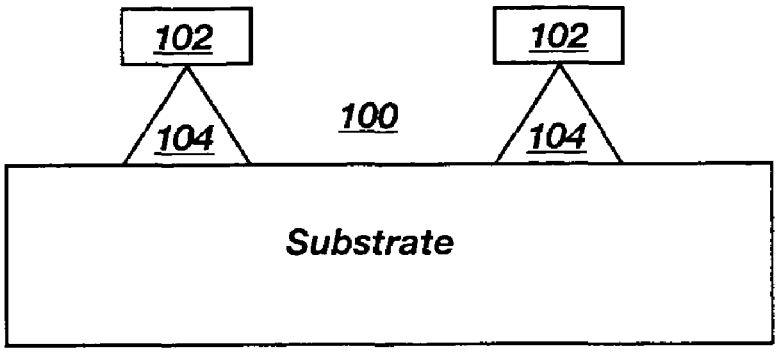
Fig. 2 (PRIOR ART)
Figure 3:
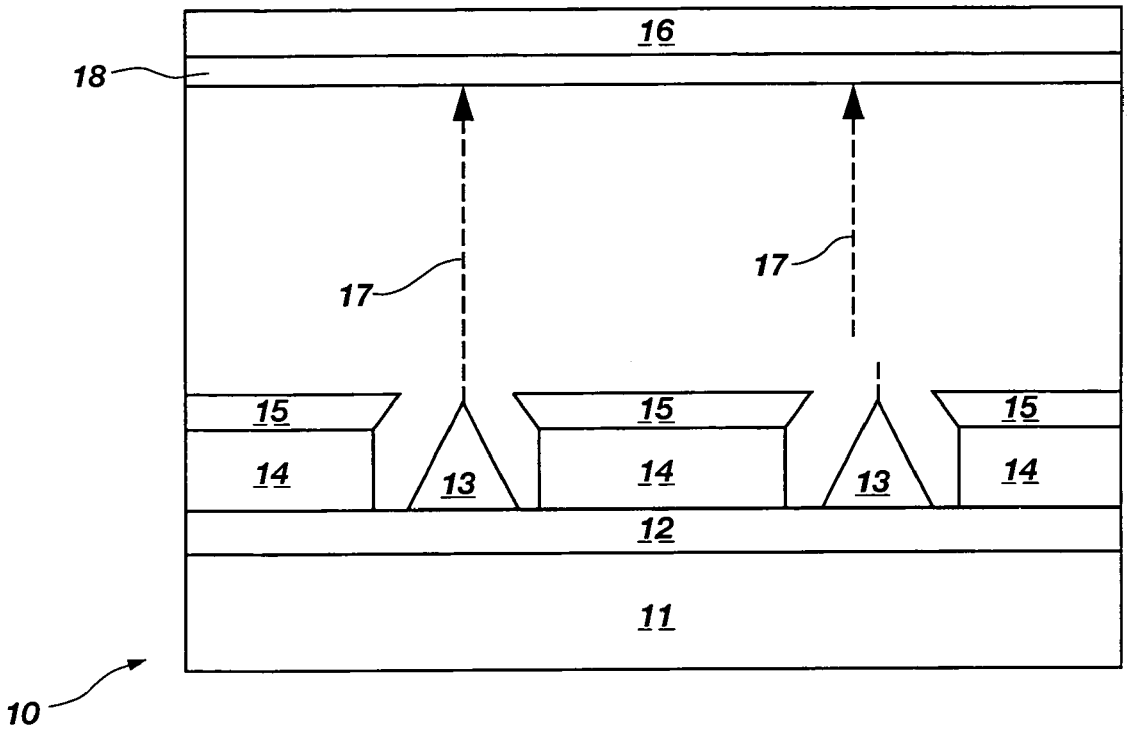
FIGS. 3 through 8 illustrate cross-sectional views of a process of forming emitters according to the present invention.
Figure 4:
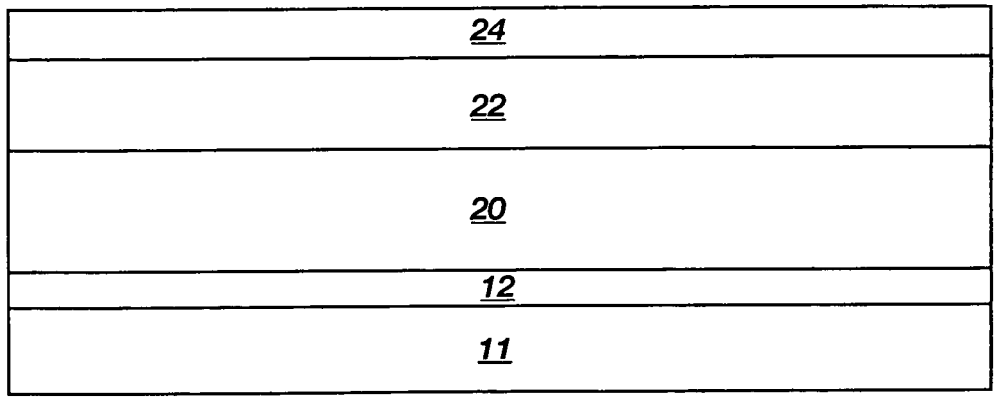
Figure 5:
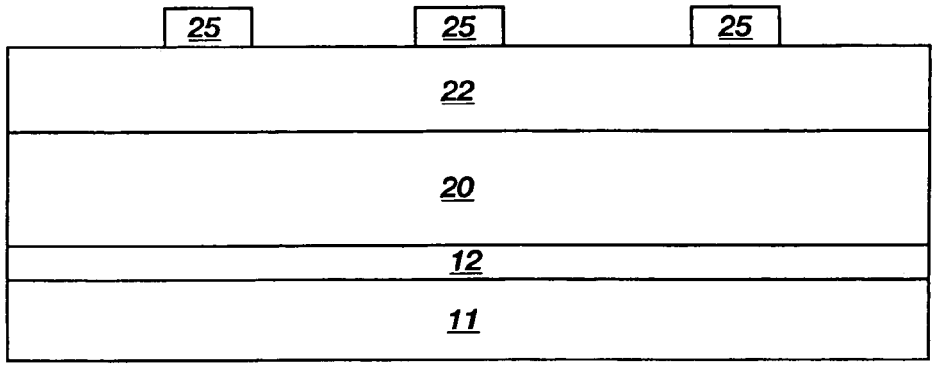
Figure 6:
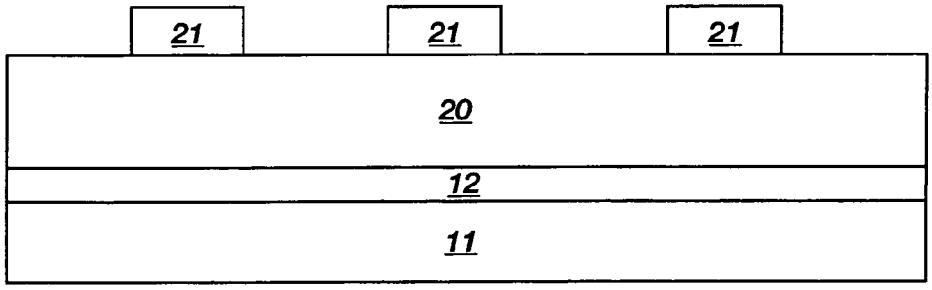

Illustrated in drawing FIG. 3 is a cross-sectional view of an FED 10 containing emitters manufactured according to the present invention. In drawing FIG. 3, substrate 11 comprises any suitable material, such as glass or a ceramic material. Substrate 11 may also be made from other materials such as silicon, optionally with a glass layer deposited thereon. Preferably, a glass panel serves as substrate 11. Conducting layer 12 is disposed on substrate 11. Any conductive material, such as metals or metal alloys, can be used as conducting layer 12. Preferably, conducting layer 12 is a metal, such as aluminum, or an alloy or compound thereof.

Emitter 13 is positioned on substrate 11 and conducting layer 12. Emitter 13 serves as a cathode conductor, and although any shape providing the necessary emitting properties can be used, a conical shape is preferred. Emitter 13 may comprise any emitting material, and preferably comprises a low work function material, i.e., a material which requires little energy to emit electrons, coated on the tip. Low work function materials include noble materials such as Mb, Si, cermet ($Cr_3Si+SiO_2$), cesium, nitride metals, niobium, and diamond-like carbon. The low work function material is preferably coated on the emitter tip.

Surrounding emitter 13 is gate electrode 15. Gate electrode 15 is formed of a conductive material, such as aluminum (Al), tungsten (W), chromium, or molybdenum. Preferably, the gate electrode comprises aluminum (Al). When a voltage differential is applied between emitter 13 and gate electrode 15, a stream of electrons in the form of beam 17 is emitted toward display screen 16 (serving as an anode) with phosphor coating 18. Insulating layer 14 is disposed between conducting layer 12 and gate electrode 15. Any insulating material may be used as insulating layer 14, such as silicon nitride or silicon oxide. Insulating layer 14 flanks emitter 13.

An FED containing the emitters of the present invention can be formed by many processes, including the process described below and illustrated in FIGS. 4 through 8. First, conducting layer 12 is formed on substrate 11. Conducting layer 12 may be formed by any suitable process, such as one which does not degrade substrate 11. Preferably, conducting layer 12 is deposited by a sputtering process, such as sputtering the selected metal in a vacuum containing argon (Ar). The thickness of conducting layer 12 can range from about 0.1 microns to about 0.6 microns, and is preferably about 0.3 microns.

Emitting layer 20 is then formed over substrate 11 and conducting layer 12. Emitting layer 20 comprises any material capable of emitting electrons from which emitter 13 can be fabricated. Preferably, emitting layer 20 is an amorphous silicon layer. The preferred amorphous silicon layer can be formed by any suitable process yielding the desired chemical and physical properties. Preferably, the amorphous silicon layer is formed by a chemical vapor deposition (CVD) process such as a plasma enhanced chemical vapor deposition process (PECVD). If desired, emitting layer 20 can be doped with appropriate dopants. The thickness of emitting layer 20 can range from about 0.5 microns to about 1.5 microns, and is preferably about 1.0 microns.

Mask layer 22 is then formed on emitting layer 20. Mask layer 22 comprises any material, as described below, that can be used as an etch mask for emitting layer 20. Preferably, mask layer 22 is a doped or undoped silicon oxide layer, such as silane oxide. Mask layer 22 may be formed by any suitable process yielding the desired characteristics for the layer. For example, when silicon oxide is employed as mask layer 22, it may be deposited by physical vapor deposition (PVD) or CVD. Preferably, silicon oxide is deposited by a plasma enhanced chemical vapor deposition process (PECVD). The thickness of mask layer 22 can range from about 0.10 microns to about 0.25 microns, and is preferably about 0.22 microns.

Photoresist layer 24 is then deposited on mask layer 22. Photoresist layer 24 is used to form discrete etch masks from mask layer 22. Photoresist layer 24 can be any conventional photoresist material formed by any suitable process in the art. Preferably, photoresist layer 24 is formed as a positive photoresist. Photoresist layer 24 is then developed by means known in the art to form the desired photoresist pattern. Unnecessary portions of the photoresist layer 24 are then removed, leaving discrete photoresist masks 25 overlying mask layer 22, as depicted in drawing FIG. 5.

Next, selective portions of mask layer 22 which are not covered by the photoresist pattern are removed, resulting in etch masks 21, which are of a similar pattern as photoresist masks 25. Selective removal of mask layer 22 is accomplished preferably through a dry plasma etch, but any suitable isotropic etching technique can be employed. In this plasma etch method, the etchants used to etch the preferred silicon oxide mask layer 22 include, but are not limited to, halogen gases, such as chlorine or fluorine, and gases containing fluorine, such as $CF_4$, $CHF_3$, $C_2F_6$, and $C_3F_6$. Other gases, such as argon (Ar), can be included in the plasma atmosphere. The etchant gases selectively etch silicon oxide without removing photoresist masks 25. Photoresist masks 25 are then removed by any suitable method known in the art. The resulting structure, as illustrated in drawing FIG. 6, contains etch masks 21 of mask layer 22 material (e.g., silicon oxide) overlying emitting layer 20.

Figure 7:
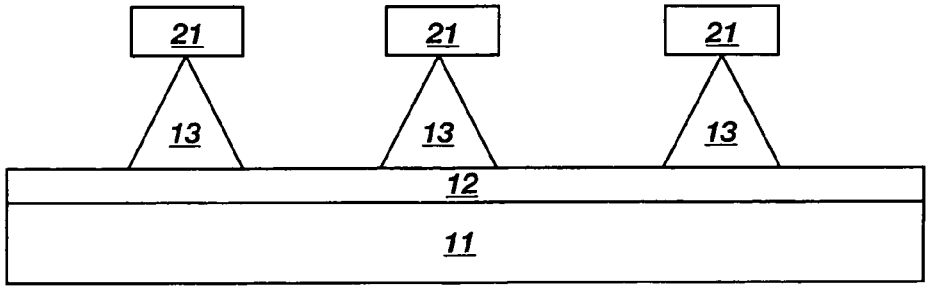

Next, as illustrated in drawing FIG. 7, emitters 13 are formed from emitting layer 20 using etch masks 21. Emitters 13 are formed by etching emitting layer 20 until the desired shape of the emitters is obtained. Preferably, emitters 13 have a conical shape since this shape provides good emission properties, but any shape providing good emission characteristics can be formed. Any suitable process removing portions of emitting layer 20 to form the desired emitter shape can be employed. To form the preferred conical shape of emitters 13, an anisotropic etching process is employed.

Figure 8:
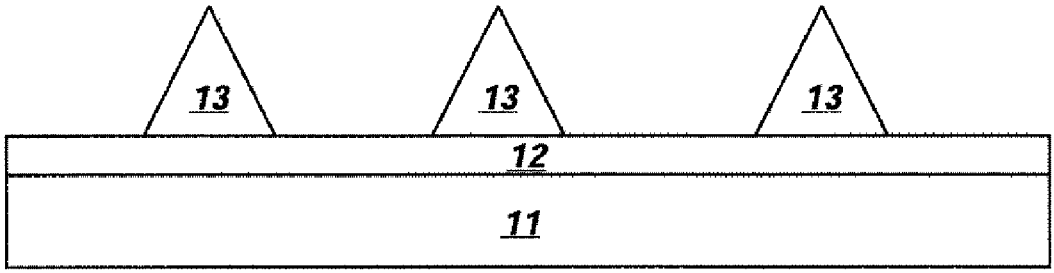

Next, etch masks 21 are removed, leaving the structure depicted in drawing FIG. 8. Any suitable process which removes etch masks 21 without degrading emitters 13 can be used. Preferably, when etch masks 21 comprise silicon oxide, a wet etchant containing a buffered hydrofluoric (HF) acid solution is used to remove these etch masks. Other acid solutions, such as phosphoric acid solutions, can be used, provided they do not attack or degrade emitters 13 or conducting layer 12. It should be understood that the conducting layer 12 has been patterned prior to the deposition of the emitting layer 20 using the plasma enhanced chemical vapor deposition process (PECVD).

The above process is performed to obtain a controlled distribution of emitter heights (or sizes), including at least one desired emitter size present throughout the panel in every pixel. As discussed above, conventional emitter arrays are unfortunately non-uniform, with longer emitters in the interior of the panel and shorter emitters in the periphery of the panel. The present invention provides more uniform emitter sizes by compensating for the etching which forms such non-uniform emitters.

The preferred method of obtaining the controlled distribution of emitter sizes is described below. In the preferred method, at least one desired emitter size is first selected and, preferably, a single desired emitter size is selected. The desired size of the emitter depends on numerous factors, such as the type of display device, the material used in emitting layer 22, the conducting material used in the gate electrode, the voltage potential between the extraction electrode and the emitter, and the operating voltage of the anode. For example, in one type of an FED device, the desired emitter size could range from about 0.5 microns to about 1.8 microns. Preferably, the single, desired emitter size in the present invention ranges from about 1.5 microns to about 1.7 microns, and is preferably 1.6 microns.

Figure 10:
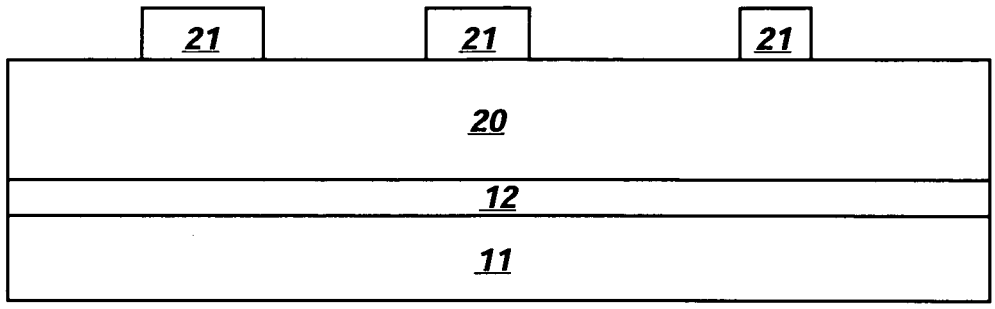
FIG. 10 illustrates the distribution of mask sizes of an embodiment of the present invention.
Figure 11:
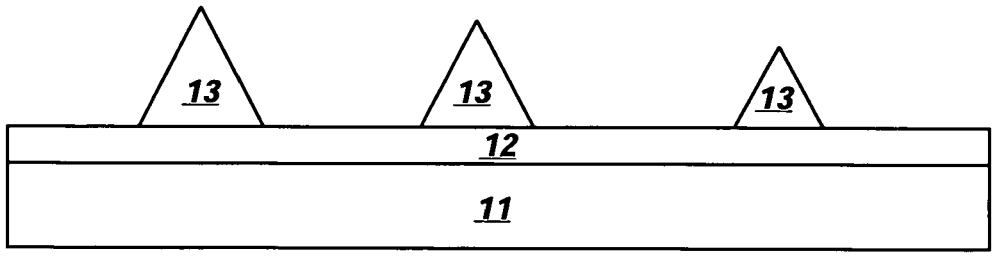
FIG. 11 illustrates the distribution of emitter heights according to an embodiment of the present invention.

Next, referring to FIG. 10, a controlled distribution of mask sizes is determined. The controlled distribution of etch mask 21 sizes is selected so that when emitting layer 20 is etched, the controlled distribution of emitter 13 sizes, including the at least one desired emitter size throughout the panel, is formed, as shown in FIG. 11. The controlled distribution of mask sizes depends in part on the number and size of etching areas (e.g., the periphery and the interior) and the number of different mask sizes to be employed.

The number and size of etching areas are selected in light of the variation in the uniformity of the etcher and the total number of emitters in a pixel. The number of etching areas should be minimized, when possible, since the more etching areas chosen, the larger the number of different emitter sizes in the display device that will result, which can decrease uniformity of the emitter sizes.

Likewise, the number of mask sizes should be minimized since the more mask sizes that are chosen, a larger number of different emitter sizes in the display device will result. The number of mask sizes must be a plurality, and preferably is an odd number with an equal number of mask sizes larger and smaller than a median mask size. The factors which must be considered are the total number of emitters in a pixel and the uniformity of the etching of the reactor etcher used.

In the controlled distribution of mask sizes, each etching area will preferably contain at least one mask of the median mask size. To obtain at least one mask of the median mask size, the relationship between the number of mask sizes and etching areas is represented by the formula $X=2N-1$, where X is the number of mask sizes and N is the number of etching areas. As an example of the controlled distribution of mask sizes, if three etching areas (i.e., periphery, interior, and middle portions) are selected, there will be five mask sizes (e.g., smallest, smaller, median, larger, and largest). The periphery will contain the median, larger, and largest mask sizes, the middle portion will contain the smaller, median, and larger mask sizes, and the interior will contain the smallest, smaller, and median mask sizes. Thus, the larger mask sizes can be located primarily in the peripheral regions of the mask and the smaller mask sizes located primarily in the interior regions of the mask. Alternately, the same mask may be used across the entire display; thus the three sizes of masks would be the same across the entire display.

The controlled distribution of mask sizes also depends on the size differential or size increment between the various mask sizes. The size increment is preferably as small as possible since the closer the mask sizes, the more uniform the emitter sizes in the panel and the better the emission properties of the emitter array. The size increment, however, is limited by the processing equipment and masking technology. For example, the size increment is currently limited to greater than 0.125 microns. The size increment must also be selected in light of the operating parameters of the etching process since etching emitting layer 20, using the controlled distribution of mask sizes, must yield the at least one desired emitter size in each pixel and as uniform an emitter array as possible. The size increment between successive mask sizes is preferably similar for simple processing, but need not be if more complex processing is acceptable. Preferably, when there is an odd number of mask sizes, the size increment is selected so that there is a corresponding pair of large and small mask sizes, with the average of their sizes being the median mask size.

Next, the mask pattern having the controlled distribution of mask sizes used to create masks 25 and masks 21 is formed. The mask pattern will have a plurality of mask sizes in each etching area and will preferably contain the median mask size in each etching area. The larger mask sizes are employed primarily in the peripheral regions to compensate for the higher degree of etching occurring there. The smaller mask sizes are employed primarily in the interior regions to compensate for the low degree of etching occurring there.

Figure 9:
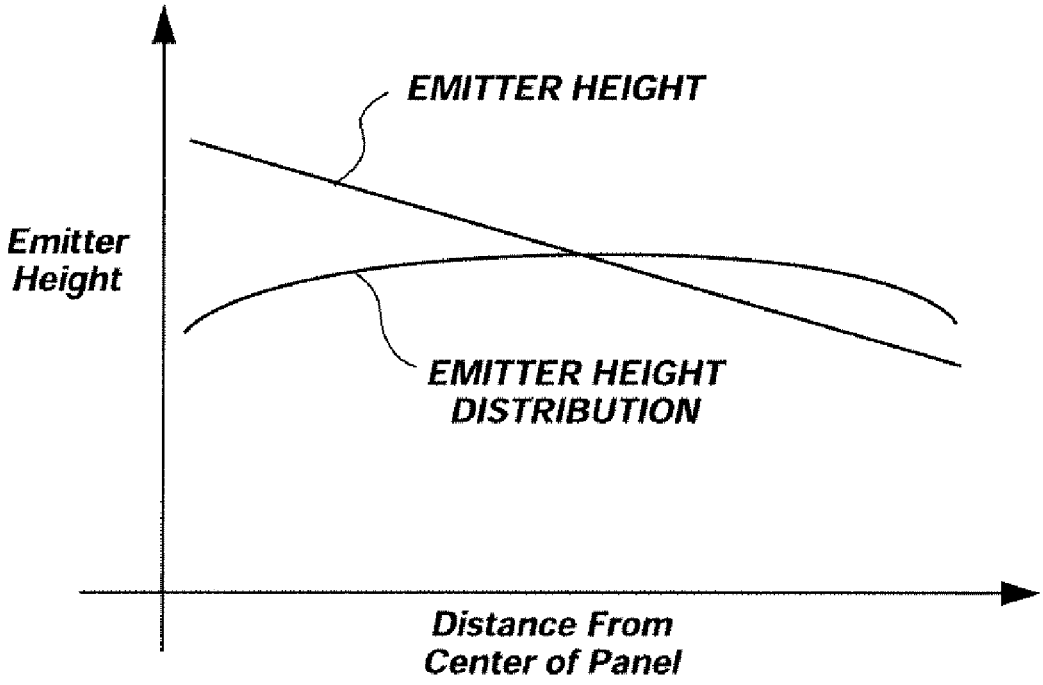
FIG. 9 illustrates the uniformity of an emitter array of the present invention.

Emitters 13 are then formed by emitting layer 20 as described above. As illustrated in drawing FIG. 9, the above process creates a controlled distribution of emitter sizes similar to a curve, with the largest area under the curve having the desired emitter size. Conventional methods, where the emitter height differs between the interior and periphery of the panel, yields a line rather than a curve. Preferably, the above process should be adjusted so that the curve is as flat as possible, thereby maximizing the uniformity of the emitter height. Preferably, the emitter size of all emitters in the FED ranges from about 1.5 microns to about 1.7 microns, and is more preferably about 1.6 microns. Preferably, the emitter height should be within about 0.5 microns to about 1.5 microns (about 3.25% to about 9.5%) of each other, and is more preferably about 1.0 microns (about 6%) of each other.

Further processing can then be undertaken to form the remainder of the FED. For example, a low work function material may be formed on the tips of emitters 13; insulating layer 14 and gate electrode 15 may be formed; and substrate 11 containing emitters 13 sealed together with the display screen.

The present invention can be illustrated by the following Example, which should not be viewed as limiting the present invention in any manner.

EXAMPLE

In a process of fabricating an FED, emitting layer 20 was formed of amorphous Si and masking layer 22 was formed of silicon oxide on a panel. The desired emitter size for the FED was 1.6 microns. To create a mask pattern, the 3 etching areas and 5 mask sizes were selected. Given the etching parameters for forming amorphous silicon emitters, as described portion of the mask contained mask sizes of 1.5, 1.6, and 1.7 microns, and the interior of the mask contained mask sizes of 1.4, 1.5, and 1.6 microns. After etching using a suitable known etching process, the periphery of the panel contained an emitter height of 1.4 microns, 1.5 microns, and 1.6 microns, the middle portion of the panel contained an emitter height of 1.5 microns, 1.6 microns and 1.7 microns, and the interior of the panel contained an emitter height of 1.5 microns, 1.6 microns and 1.7 microns, yielding the desired emitter height of 1.6 microns throughout the panel.

While the preferred embodiments of the present invention have been described above, the invention defined by the appended claims is not to be limited by particular details set forth in the above description, as many apparent variations thereof are possible without departing from the spirit or scope thereof. For example, although the method of the invention has been described as forming an emitter array for an FED, the skilled artisan will understand that the process and emitter array described above can be used for other display devices, such as plasma displays and flat cathode ray tubes.

What is claimed is:

1. An emitter array for a display device having a periphery, a middle, and an interior, each having a plurality of pixels, at least one emitter in each pixel having substantially a same height as a corresponding pixel in another emitter of the emitter array, a material for each emitter comprising amorphous silicon, the at least one emitter and the another emitter having a size within about 0.15 microns of each other in a range from about 3.25% to within 9.5% of each other, the periphery having a distribution of emitter heights of not less than 1.4 microns, 1.5 microns, and not greater than 1.6 microns, the middle having a distribution of emitter heights of not less than 1.5 microns, 1.6 micron, and not greater than 1.7 microns, and the interior having a distribution of emitter heights of not less than 1.5 micron, 1.6 microns, and not greater than 1.7 microns.

2. The array of claim 1, wherein the display device is a field emission display device.

3. The array of claim 2, wherein the at least one emitter has a size ranging from about 1.5 microns to about 1.7 microns.

4. The array of claim 3, wherein the at least one emitter has a size of about 1.6 microns.

5. The array of claim 4, wherein a size of all emitters in the display device ranges from about 1.5 microns to about 1.7 microns.

6. An emitter array for a display device having a plurality of pixels, at least one emitter in each pixel having substantially a same height as a corresponding pixel in another emitter of the emitter array, a material for each emitter comprising amorphous silicon, the at least one emitter and the another emitter having a size within about 0.15 microns of each other, the at least one emitter having a height of no less than 1.4 microns.

7. The array of claim 6, wherein the display device is a field emission display device.

8. The array of claim 7, wherein the at least one emitter has a size ranging from about 1.5 microns to about 1.7 microns.

9. The array of claim 8, wherein the at least one emitter has a size of about 1.6 microns.

10. The array of claim 9, wherein a size of all emitters in the display device ranges from about 1.5 microns to about 1.7 microns.

11. An emitter for a display device having a plurality of pixels, an emitter in each pixel having substantially a same height as another emitter in a corresponding pixel of the emitter display, a material for each emitter comprising amorphous silicon, the emitter and the another emitter having a size within about 0.15 microns of each other in a range from about 3.25% to within 9.5% of each other, the at least one emitter having a height of no less than 1.4 microns.

12. The display device of claim 11, wherein the display device comprises a field emission display device.

13. The display device of claim 12, wherein the emitter has a size ranging from about 1.5 microns to about 1.7 microns.

14. The display device of claim 13, wherein the emitter has a size of about 1.6 microns.

15. The display device of claim 14, wherein the size of substantially all emitters in the display device ranges from about 1.5 microns to about 1.7 microns.

16. An emitter array having a plurality of pixels, an emitter in each pixel having substantially a same height as another emitter of a corresponding pixel of the emitter display, a material for each emitter comprising amorphous silicon, the emitter and the another emitter having a size within about 0.15 microns of each other in a range from about 3.25% to within 9.5% of each other, the at least one emitter having a height of no less than 1.4 microns.

17. The array of claim 16, wherein the display device comprises a field emission display device.

18. The array of claim 7, wherein the emitter has a size ranging from about 1.5 microns to about 1.7 microns.

19. The array of claim 18, wherein the emitter has a size of about 1.6 microns.

20. The array of claim 19, wherein the size of substantially all emitters in the display device ranges from about 1.5 microns to about 1.7 microns.

* * * * *

UNITED STATES PATENT AND TRADEMARK OFFICE

CERTIFICATE OF CORRECTION

PATENT NO. : 7,271,528 B2
APPLICATION NO. : 10/715058
DATED : September 18, 2007
INVENTOR(S) : Knappenberger It is certified that error appears in the above-identified patent and that said Letters Patent is hereby corrected as shown below:

In column 8, line 55, in Claim 18, delete “claim 7,” and insert -- claim 17, --, therefor.

Signed and Sealed this

Fourth Day of December, 2007

JON W. DUDAS
*Director of the United States Patent and Trademark Office*